United States Patent [19]

Willis, Sr.

[11] Patent Number: 4,459,769

[45] Date of Patent: Jul. 17, 1984

[54] SNOWPLOW ATTACHMENT

[76] Inventor: William R. Willis, Sr., Rte. 10, P.O. Box 19, Grantham, N.H. 03753

[21] Appl. No.: 406,273

[22] Filed: Aug. 9, 1982

[51] Int. Cl.[3] ..... E01H 5/06

[52] U.S. Cl. ..... 37/275

[58] Field of Search ..... 37/272, 273, 274, 275, 37/281, 279, 232, 233

[56] References Cited

U.S. PATENT DOCUMENTS

| | | | |
|---|---|---|---|
| 1,718,360 | 6/1929 | Kaczorowski | 37/274 |
| 2,055,291 | 9/1936 | Henry | 37/233 |
| 2,103,775 | 12/1937 | Frink | 37/232 |

*Primary Examiner*—E. H. Eickholt

*Attorney, Agent, or Firm*—Dufault & Dufault

[57] ABSTRACT

An attachment, with self-contained springs, removably attached to the upper edge of a snowplow blade and designed so as to prevent snow from moving over the plow blade while plowing snow and to deflect the snow laterally away from the plow blade.

6 Claims, 5 Drawing Figures

SNOWPLOW ATTACHMENT

This invention relates to a removable attachment for the upper edge of a vehicle driven snowplow capable of preventing snow from being deflected over the snowplow blade and capable of pushing snow laterally away from the snowplow.

When snow is being plowed by vehicles, especially at higher speeds, some of the snow tends to go up and over the plow blade and is thrown against the vehicle's windshield causing a safety hazard. There have been some previous attempts at making devices capable of preventing snow from being projected up and over the snowplow blade. However, these devices have not been adopted for use by snowplowers because they were either too bulky, difficult to attach, simply a flat extension of the plow moldboard, made primarily for V-type snowplows or they pushed the snow behind the snowplow blade and into the path of the truck. In addition, none have been made so as to prevent snow from obstructing the vision of the vehicle's driver and to increase the effectiveness of the snowplow by channeling the snow laterally away from the snowplow. Most devises for deflecting the snow were primarily for V-type snowplows and would, consequently, throw the snow back into the path of a straight snowplow blade. In addition, when pushing snow piles that are higher than the plow blade, a rigid snow deflector causes the plow blade to rise up due to the upward pressure being placed on the upper portion of the plow blade by the upward movement of the snow. When the need for a flexible deflector was realized, the spring unit was not self-contained, attachment to the plow difficult or the deflector was adjusted manually or hydraulically. None of the previous attempts at making a deflector resulted in one that was easy to attach and had a self-contained spring unit capable of yielding under increased snow pressure. Because the above mentioned deflectors have not been satisfactory under road snowplowing conditions, the present method to eliminate the problem of snow coming over the plow blade is to place a piece of canvas over the top of the plow blade. This procedure, while minimizing the problem of snow on a vehicle's windshield somewhat, has not been completely satisfactory.

Accordingly it is an object of the present invention to provide a new and improved mechanism for the prevention of snow from being blown up and over the plow blade and onto the windshield of the vehicle, thus eliminating a safety hazard created by the snow's obstructing the vision of the driver.

Another object is to provide a snow deflector capable of rotating backwards when upward pressure is applied to the attachment due to the movement of snow up the plow blade, which would otherwise cause the plow blade to rise and to decrease plowing efficiency.

Another object is to simplify the means by which a snow deflector is attached to a snowplow blade.

Another object is to provide a snow deflector with a self-contained spring as a single unit.

Another object is to design a snow deflector attachment capable of being made for all snowplow blade widths.

Another object is to laterally deflect the snow that comes up the plow blade to the deflector, thus increasing the efficiency of the snowplow.

These and still further objects are addressed hereinafter.

The foregoing objects are achieved, generally, by the attachment of a snow deflector, equal in width to a snowplow blade. The deflector has a general concave shape that extends in a forward direction from a lower straight planar edge. The central portion of the deflector, however, extends more forwardly than the side into a V-relation over the straight moldboard portion. When the attachment is placed on the upper portion of a snowplow blade, the snow is not blown up and over the snowplow and onto the windshield of the vehicle, thus eliminating a safety hazard. In addition, the unique design of the attachment with the midpoint V extending forward more than the curvilinear sides, causes the snow to be channelled laterally away from the plow blade on both sides and thus increases the efficiency of the snowplow. The deflector attachment is also so designed that when the plow blade is set at an angle to the vehicle, the invention, in addition to preventing the snow from being thrown up and over the blade onto the windshield of the vehicle, allows the snow to be deflected and channelled in the same direction as the plow blade. A mechanism is also provided by which the attachment can yield under increased upward pressures exerted by the upward moving snow. This is accomplished by the addition of self-contained springs hinged so as to allow the deflector to tilt backwards, thus relieving the upward pressure and preventing the plow blade from rising up, while still preventing snow from moving over the attachment and reaching the vehicle's windshield. The amount of pressure on the deflector can be adjusted by simply adjusting the pressure on the springs prior to plowing. During operation, however, no adjustments need be made since the spring tension is sufficient to keep the deflector in a forward position and only when the snow pressure becomes greater than the spring compression pressure does the deflector rotate backwards. The self-contained compression springs also allow for ease of attachment. The entire deflector unit can be attached to the plow blade with as few as three or four bolts. With this invention the springs no longer have to be mounted separately to the snowplow moldboard.

This invention is hereinafter explained with reference to the accompanying drawing in which.

Figure 1:
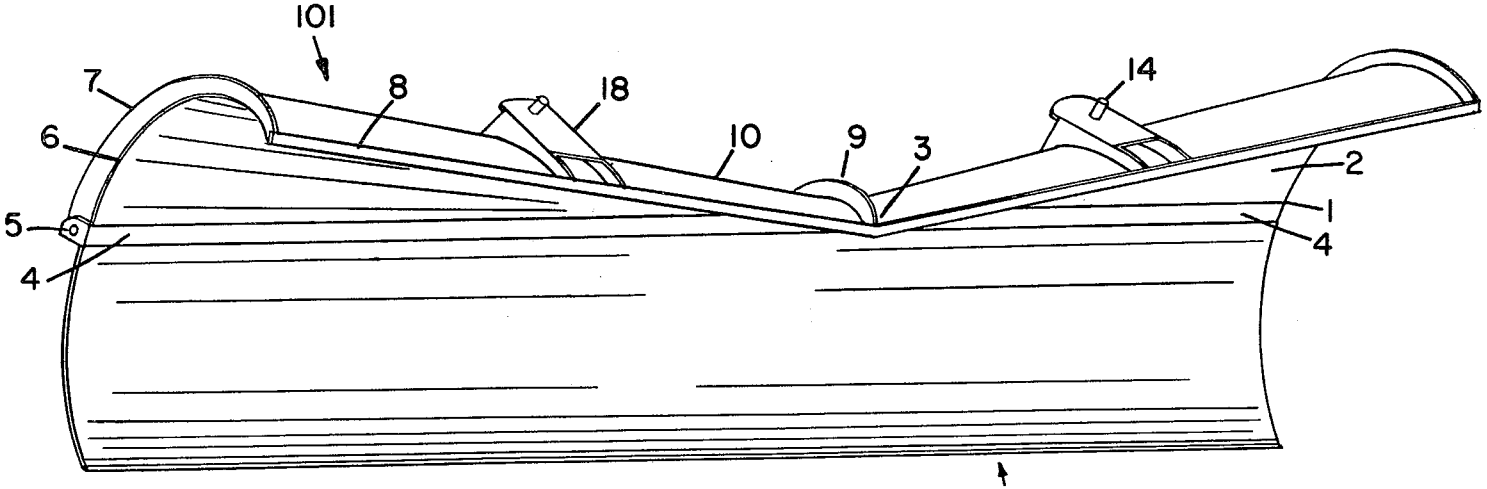
FIG. 1 is a front isometric view of the attachment in place on top of a conventional vehicle driven snowplow blade, illustrating the curved design of the attachment wherein the middle of the attachment is pulled forward and down forming a V-type shape.
Figure 2:
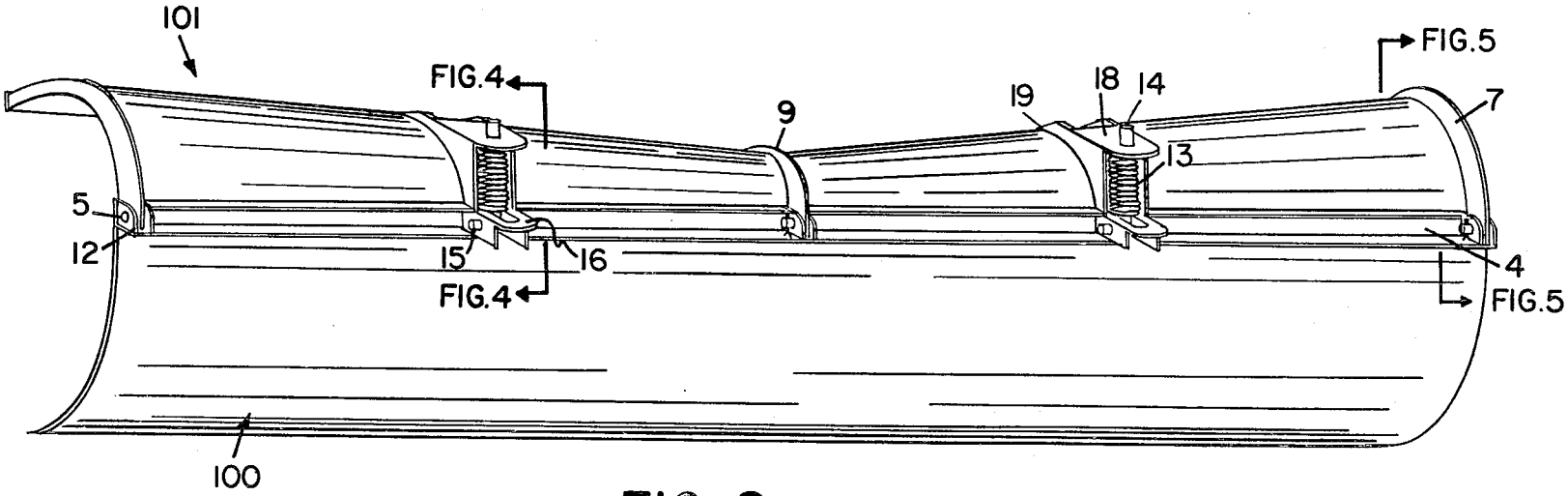
FIG. 2 is a rear isometric view of the attachment in place on top of a conventional vehicle driven snowplow blade showing the curved design of the attachment and the relative position of the self-contained compression springs.
Figure 3:
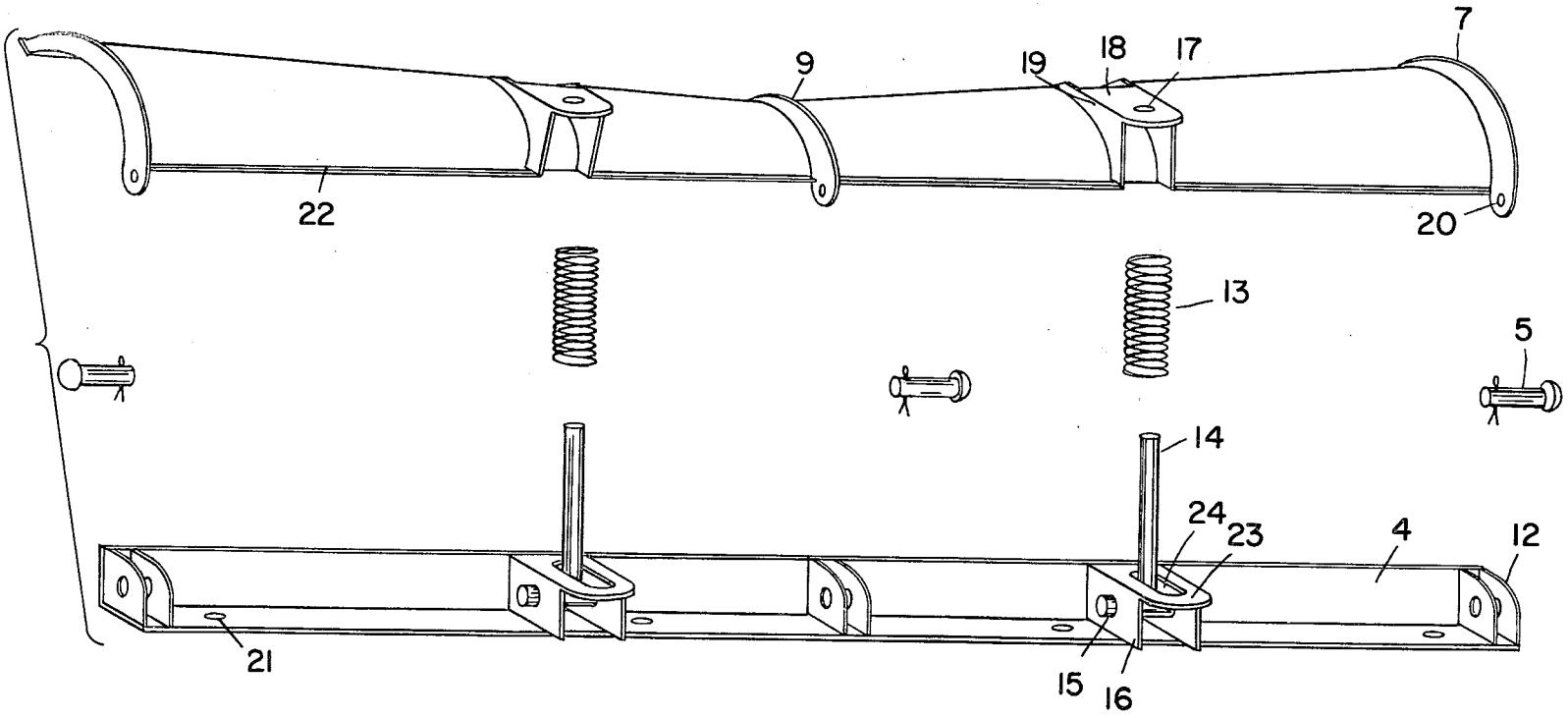
FIG. 3 is an exploded rear view of the attachment wherein the self-contained compression springs and the mechanism for allowing the attachment to yield under increased snow pressure is shown.
Figure 4:
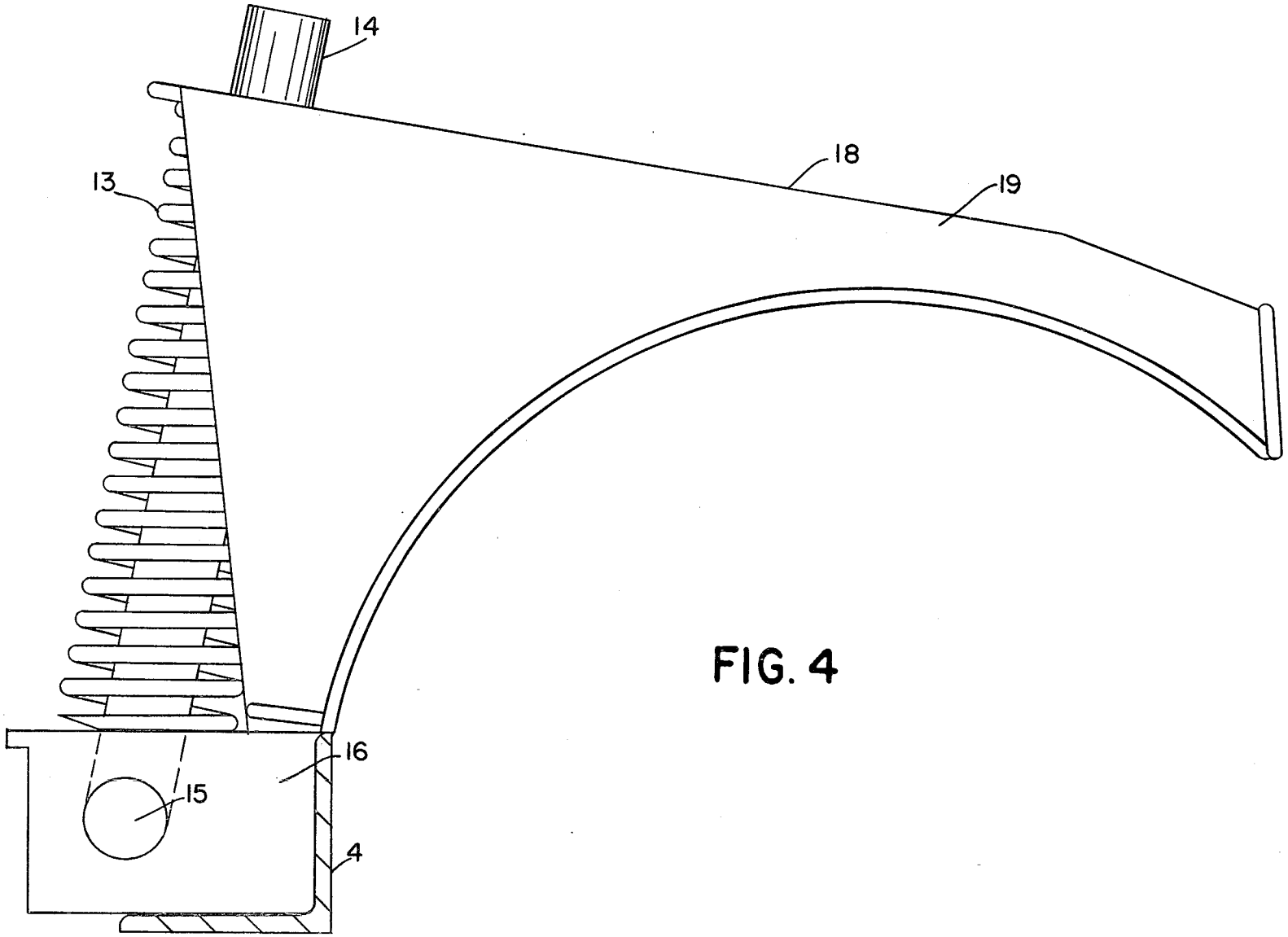
FIG. 4 is an enlarged cross sectional view of the self-contained compression spring on the line 4—4 in the direction of the arrows in FIG. 2.
Figure 5:
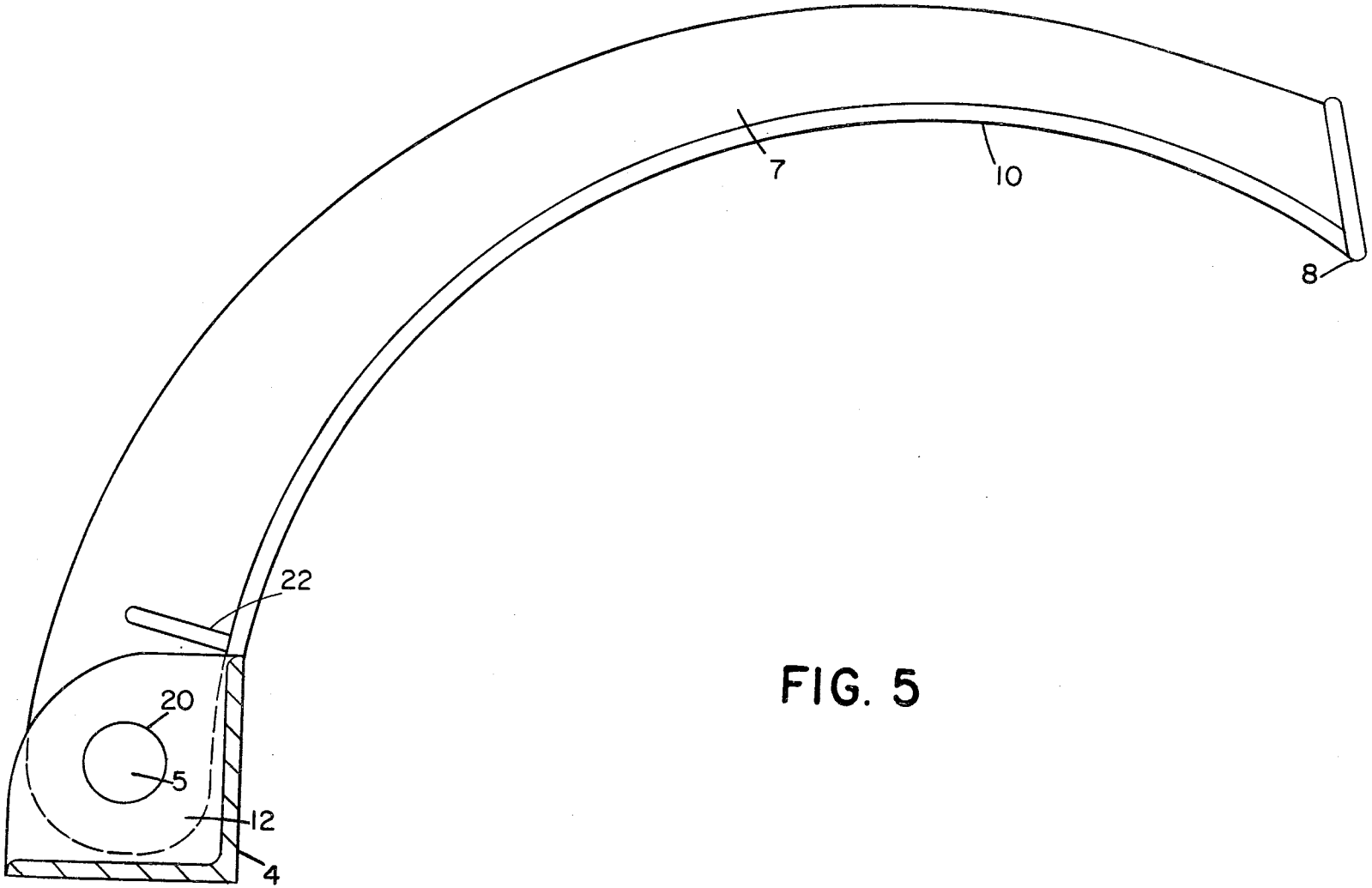
FIG. 5 is an end view on the line 5—5 in the direction of the arrows in FIG. 2 of the structural rib.

Turning now to FIG. 1, there is shown at 101 an attachment for use in connection with a vehicle driven snowplow which prevents snow from being propelled in an upward and rearward direction upon the vehicle's windshield, aids in the lateral movement of the snow from the plow blade and aids in preventing the plow blade from rising up when plowing in deep snow. The typical attachment 101 is connected to a snowplow blade 100 that is conventional and not intended to be part of this invention. The attachment 101 is a unitary curved deflector equal in width to the snowplow blade 100 and attached to the top of said blade. The deflector has a lower straight planar edge 1 and two curvilinear deflector portions 2 that extend upward and forward from the straight lower blade edge 1 into a concave configuration. The two curvilinear side portions 2 form, at the midpoint, a V-type configuration 3 that extends more forwardly and downwardly than the ends of the deflector portions and thus form the V-type configuration. This shape prevents the snow from being thrown over the attachment and also converts the upward moving snow into a lateral direction and away from the plow blade. An angle iron 4 is bolted solidly to the upper portion of the conventional plow blade 100 and in turn is used to attach the deflector to the plow blade 100 with a pin 5 that allows the deflector to rotate. The side edges 6 and front edge 8 are reinforced with steel strap as is the bottom edge 22 which is shown more clearly in FIG. 5. Structural ribs 7 on both ends and in the center 9 aid in giving the sheet metal or other similar materials which are used for the main part of the attachment 10, its structural strength. The structural ribs are also used to attach the deflector to the angle iron 4 via a gusset 12 and pin 5 shown in greater detail in FIGS. 3 and 5. FIG. 2 is a rear view of the attachment and shows how the self-contained springs are positioned on the deflector portion of the attachment. FIG. 3 is an exploded rear view of the attachment and shows in more detail how the attachment itself is assembled so that it can have self-contained springs to allow the deflector to yield and rotate backwards when snow pressure on the deflector exceeds a certain quantity. The compression springs 13 are mounted over guide rods 14 that in turn are welded to small perpendicular rods 15 that fit into a gusset 16 with holes which allows the self-contained spring assembly to rotate with the deflector. The gusset 16 also has a top plate 23 with an elongated hole 24 through which the guide rod 14 fits and enables the guide rod to move back and forth. The upper end of the guide rod 14 fits into a hole 17 in a bracket that is in turn attached to the deflector by a top 18 and two side 19 braces. The top brace 18 has a hole in it for the top end of the spring guide rod 14. The hole 17 is large enough so that the guide rod 14 can slide through said hole as the deflector rotates backwards and the spring compresses. FIGS. 3 and 5 also show how the deflector itself is attached to the angle iron 4 by way of a hole 20 drilled into the bottom of the strutural ribs 7 and 9 which in turn connect by way of a pin 5 which fits through gusset 12 and structural rib holes 20. The angle iron is attached to the upper plow blade by bolting 21 the angle iron directly to the plow blade. Thus, the angle iron is bolted solidly to the upper snowplow blade and the deflector is allowed to rotate by the unique hinging via the structural ribs and compression springs. The self-contained spring unit is shown in more detail, in place, in FIG. 4 whereby the guide rod 14 fits inside of the spring 13 and when pressure is applied to the deflector surface 2, the attachment can rotate backwards via the gusset 16 hole that contains the perpendicular rod 15 attached to the guide rod 14.

Further modifications of the invention herein disclosed will occur to persons skilled in the art and all such modifications are deemed to be within the spirit and scope of the invention as defined by the appended claims.

What is claimed is:

1. For use in connection with a vehicle driven snowplow which otherwise tends, at higher plowing speeds, to propel snow in an upward and rearward direction upon the vehicle's windshield and which also tends to cause the snow to be rolled back into the path of the snowplow, an attachment yieldably mounted to the top of said snowplow blade, that comprises:

a. a unitary curved deflector equal in width to the snowplow blade and attached to the top of said blade having a lower straight planar edge and two curvilinear deflector portions that extend in an upward and forward direction from the said straight lower blade edge into a concave configuration; said two curvilinear portions form, at the midpoint, a V-type configuration that extends in a more forward and downward direction than the ends of the deflector portions and thus forming said V-type configuration;

b. self-contained adjustable compression springs that allow the attachment to rotate backwards when snow pressure becomes greater than the forward force exerted by the compression springs; and c. a means whereby said attachment is removably attached to the top of a conventional snowplow blade.

2. An attachment, as claimed in claim 1, further comprising compression springs that are attached to the deflector by means of a metal guide rod inside of a spring; said guide rod having a lower portion attached to an angle iron base by an attached perpendicular rod which in turn is loosely fitted into two gussets welded to the angle iron base which allow the spring assembly to rotate on the said perpendicular rods; said guide rod having an upper portion which fits into a hole in a bracket that is attached to the backside of the deflector by means of side and top braces.

3. An attachment, as claimed in claim 1, further comprising an angle iron equal in width to the attachment whereby said angle iron contains a means for attaching the deflector to the angle iron and said angle iron is attached to the top of the snowplow blade.

4. An attachment, as claimed in claim 1, further comprising structural metal ribs on the back of the attachment for the dual purpose of structural support and yieldable attachment to the angle iron base plate.

5. An attachment, as claimed in claim 3, further comprising a multiple of metal gussets with holes drilled whereby the deflector portion is attached to the angle iron by a pin extending through the gusset and a hole on the bottom of the structural ribs.

6. An attachment, as claimed in claim 3, further comprising double metal gussets attached to the angle iron so positioned and spaced apart and with drilled holes whereby said gussets are used to accept the perpendicular rods attached to the guide rods.

* * * * *